United States Patent [19]

Allen

[11] Patent Number: 4,678,093

[45] Date of Patent: Jul. 7, 1987

[54] MUSICAL BABY BOTTLE

[75] Inventor: Sammy G. Allen, Magnolia, Tex.

[73] Assignee: Ronny Sewalt, Magnolia, Tex.

[21] Appl. No.: 811,102

[22] Filed: Dec. 19, 1985

[51] Int. Cl.[4] ..... A61J 9/00; G10H 5/04

[52] U.S. Cl. ..... 215/11 R; 215/100 R; 84/94 C; 84/171; 369/63; 200/220; 200/DIG. 18

[58] Field of Search ..... 215/11 R, 11 A–11 E, 215/1 R, 100 R; 128/359, 360; 455/344, 351; 40/455; 84/2, 170, 171, 94 C; 200/DIG. 18, 220; 369/63, 65, 67, 68

[56] References Cited

U.S. PATENT DOCUMENTS

| | | | |
|---|---|---|---|
| 1,589,138 | 6/1926 | Fisk | 215/11 E |
| 2,103,744 | 12/1937 | Dumble | 200/DIG. 18 X |
| 2,929,290 | 3/1960 | Smith | 215/11 C |
| 3,226,528 | 12/1965 | Martin | 369/63 X |
| 3,627,161 | 12/1971 | Wergeland | 215/11 C |
| 4,531,310 | 7/1985 | Acson et al. | 40/455 X |
| 4,554,919 | 11/1985 | Hubert | 128/360 |

FOREIGN PATENT DOCUMENTS

| | | | |
|---|---|---|---|
| 88219 | 9/1983 | European Pat. Off. | 128/360 |
| 2630246 | 1/1978 | Fed. Rep. of Germany | 455/351 |
| 2530461 | 1/1984 | France | 215/11 R |
| 81/02215 | 8/1981 | PCT Int'l Appl. | 40/455 |
| 2155858 | 10/1985 | United Kingdom | 40/455 |

*Primary Examiner*—William Price
*Assistant Examiner*—Sue A. Weaver
*Attorney, Agent, or Firm*—Dula, Shields & Egbert

[57] ABSTRACT

A musical baby bottle comprising a nipple, a liquid container connected to the nipple, a base section fastened to an opening at the bottom of the liquid container, a microchip having musical information fastened to the interior of the base section, a speaker electrically connected to the microchip and fastened to the interior of the base section, a battery electrically connected to the microchip and fastened to the interior of the base section, and a switch electrically connected to the microchip for selectively activating the microchip. The switch comprises a mercury switch fixedly positioned within the base section. The mercury switch is tilted such that the off-position of the switch is closer to the bottom of the base section than is the on-position of the mercury switch. A second mercury switch is positioned within the base section and is angularly offset from the first mercury switch. A third mercury switch is also fixedly positioned within the base section and is also angularly offset from the other mercury switches. An insulative fill material is fastened to the base section such that the microchip, the speaker, the battery, and the switch are inaccessible from the exterior of the base section.

3 Claims, 7 Drawing Figures

MUSICAL BABY BOTTLE

TECHNICAL FIELD

The present invention relates to baby bottles. Also, the present invention relates to musical instruments and, in particular, those used during feeding.

BACKGROUND ART

Baby bottles have been in continuous use for many, many years. Baby bottles are used for the nursing and feeding of infant children. Over the years, these baby bottles have come in various forms, shapes, and configurations.

Since infant children are often temperamental during feeding, it is often agreeable to accompany the feeding with pleasant music. Such music can soothe and amuse the child. This music can often divert the child's attention from the feeding process itself.

It is an object of the present invention to provide a baby bottle with a source of music attached thereto.

It is another object of the present invention to provide a musical baby bottle that is relatively simple to manufacture and to attach to existing baby bottles.

It is a further object of the present invention to provide a musical baby bottle is actuable by the movement of the bottle itself.

It is still a further object of the present invention to provide a musical baby bottle that is inherently safe for the baby being fed.

These and other objects and advantages of the present invention will become apparent from a reading of the attached specification and appended claims.

DISCLOSURE OF THE INVENTION

The present invention is a musical baby bottle that comprises a nipple, a liquid container connected to the nipple, a base section fastening to an opening about the liquid container, a microchip having musical information encoded therein, a speaker electrically connected to the microchip, a battery electrically connected to the microchip and a switch electrically connected to the microchip. The base section is removably fastened to the liquid container. The microchip is fastened to the interior portion of the base section. Similarly, the battery and the switch are connected about the interior of the base section.

The base section has a generally round exterior configuration and a beveled upper surface. This beveled upper surface engages the inner surface of the liquid container. The base section also has a flat surface across the top of the beveled upper surface. This flat surface seals the interior of the base section from the interior of the liquid container. A shoulder area about the base section abuts the bottom of the liquid container.

The microchip is fastened to an insulating layer adjacent the flat surface of the base section. The speaker is a generally flat speaker and is positioned close to the surface of the base section.

The switch comprises a first mercury switch fixedly positioned within the base section. This first mercury switch is tilted so that the off-position is lower than the on-position. A second mercury switch is positioned within the base section and angularly offset from the first mercury switch. A third mercury switch is also positioned within the base section and is further angularly offset from both the first and second mercury switches.

Alternatively, a toggle switch is electrically connected to the microswitch. This toggle switch fastens to the exterior of the base section and is actuable from the exterior of the baby bottle. This toggle switch extends transverse to the longitudinal axis of the bottle.

Still further, alternatively, the switch can be a button that is electrically connected to microchip. This button can extend a small distance beyond the bottom of the base section such that when the baby bottle is upright, the button is in an "off" position. When the baby bottle is lifted from the surface, then the button is in an "on" position.

An insulative fill material fastens within the base section. This fill material encapsulates the microchip, the speaker, the battery, and the switch such that each is inaccessible from the exterior of the base section.

BEST MODE FOR CARRYING OUT THE INVENTION

Figure 1:
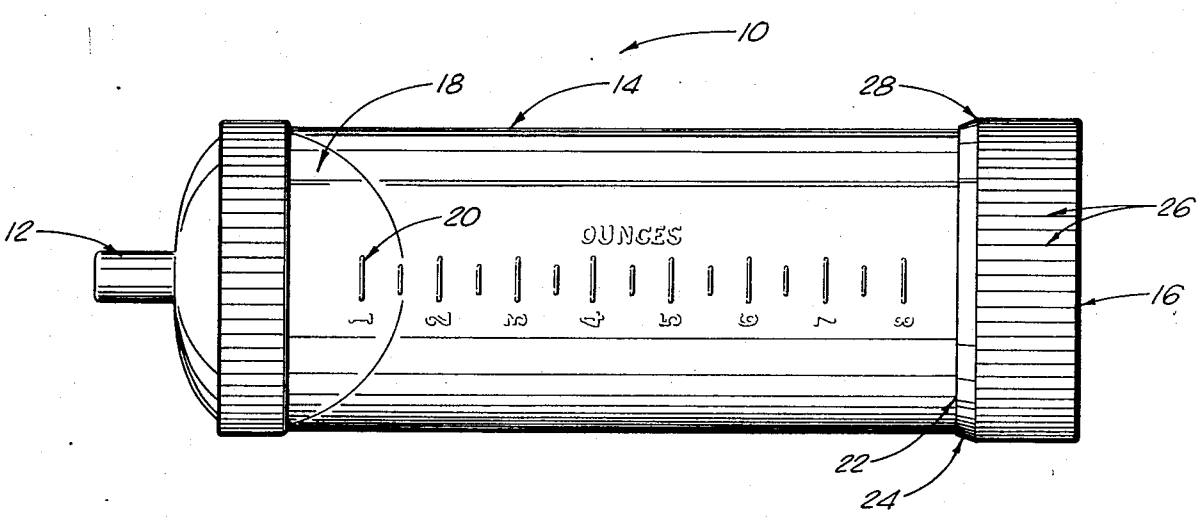
FIG. 1 is a view in side elevation of the musical baby bottle in accordance with the present invention.

Referring to FIG. 1 there is shown at 10 the musical baby bottle in accordance with the present invention. Musical baby bottle 10 comprises a nipple portion 12, a liquid container 14, and base section 16.

Nipple 12 is of generally elastomeric material that extends outwardly from liquid container 14 to form a nipple. This nipple 12 allows fluid within liquid container 14 to pass into the mouth of the baby. Milk, formula, or water are received by an elastomeric sack 18. Elastomeric sack 18 expands when fluid is introduced thereinto and provides sanitary protection for the baby. As additional fluid fills sack 18, sack 18 will expand through the length of lqiuid container 14.

Liquid container 14 is a generally cylindrical container that receives elastomeric sack 18. Liquid passes from the elastomeric sack 18 within liquid container 14 into nipple 12. Gradients 20 are marked on the side of liquid container 14 so as to indicate the level of fluid within liquid container 14. Liquid container 14 has an opening at the end 22 opposite nipple 12.

Base section 16 fastens to the opening of the liquid container 14. The friction between the end 22 of liquid container 14 and the beveled surface 24 of base section 16 causes base section 16 to be securely retained at the end of liquid continer 14. As shown in FIG. 1, base section 16 has a plurality of ridges 26 formed along the outer diameter of base section 16. Base section 16 has a generally round exterior configuration. Base section 16 slidingly and frictionally engages end 22 of liquid container 14. The shoulder 28 of base section 16 is formed at the bottom of beveled section 24. Shoulder 28 abuts the end 22 of liquid container 14 when base section 16 is connected to liquid container 14.

Figure 2:
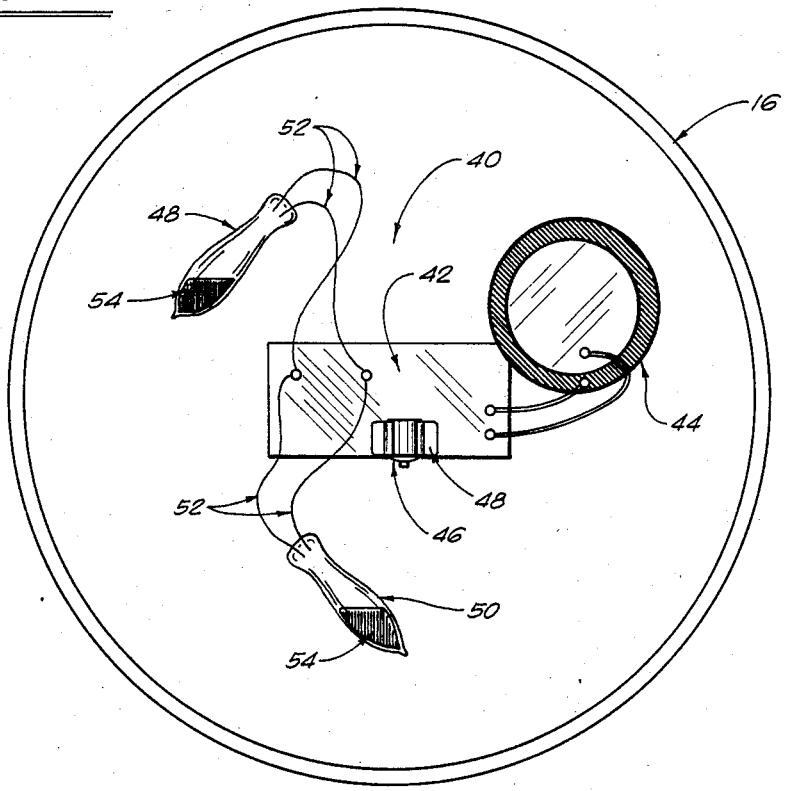
FIG. 2 is a cross-sectional view across the bottom of the baby bottle of FIG. 1.

FIG. 2 illustrates the electronics of the musical system of the present invention. In particular, electronics 40 are positioned in the base section 16. The electronics 40 comprise a microchip 42, a speaker 44, a battery 46, first mercury switch 48, and second mercury switch 50.

Microchip 42 has musical information encoded therein. Microchip 42 is fixedly fastened to the interior of base section 16. Microchip 42 is of a type that is commonly available on the market. There are various microchips presently for salt that have musical information encoded therein. For example, any of a number of pleasant musical melodies can be chosen by selectively choosing the proper microchip 42.

Speaker 44 is a flat speaker. This speaker 44 is fixed in positioned generally adjacent an outer surface of base section 16. Speaker 44 is of technology that is presently available on the market. Microchip 42 is electrically connected to speaker 44. This connection is achieved by connecting terminals available on microchip 42 to the proper terminals on speaker 44.

Battery 46 is a miniature battery that is fixed to a bracket assembly 48 on microchip 42. Battery 46 is a 44X battery. This battery 46 is fixedly fastened within the interior of base section 16. Battery 46 should provide sufficent power to properly activate microchip 42 and generate sound through speaker 44. In proper use, battery 46 should operate for a year without replacement.

In the preferred embodiment of the present invention, a pair of mercury switches 48 and 50 are fastened by rigid wires 52 to microchip 42. Wires 52 establish the electrical connection between the microchip 42 and the switches 48 and 50. Mercury switch 48 is fixedly positioned within the base section. As can be seen in FIG. 2, mercury switch 48 has a glob of mercury 54 freely rolling about the interior of mercury switch 48. In the position shown in FIG. 2, mercury 54 does not establish an electrical connection between the wires 52. Mercury switch 48 is a generally clear, sealed and somewhat cylindrical member. When base section 16 is moved, glob 54 will move within switch 48 in response to the movement.

Second mercury switch 50 is of a similar configuration as first mercury switch 48. However, second mercury switch 50 is angularly offset by 90 degrees from the longitudinal axis of first mercury switch 48. This angular offset allows different direction of movement of base section 16 to cause the activation of mercury switches 48 or 50. If either mercury switch 48 or 50 is activated by the movement of mercury 54 to wires 52, then the microchip will be become activated and music will be produced through speaker 44. Both of the mercury switches 48 and 50 must be in the off position to stop the production of sound.

Figure 4:
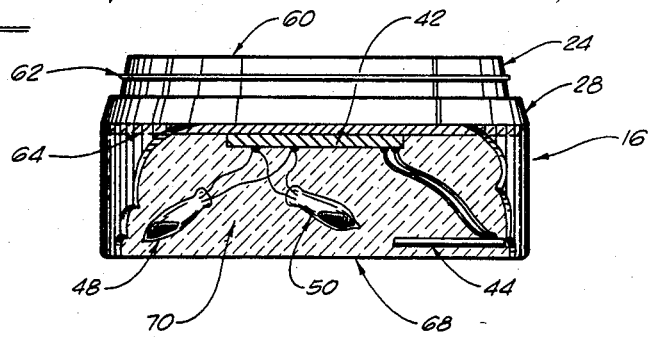
FIG. 4 is a cross-sectional side view of the base section of the baby bottle of the present invention.

FIG. 4 shows a cross-sectional view of the base section 16 in accordance with the preferred embodiment of the present invention. As can be seen in FIG. 4, base section 16 has beveled upper surface 24 extending from shoulder 28. A flat surface 60 extends across the top of the beveled upper surface 24. This flat surface 60 seals the interior of the base section 16 from the interior of liquid container 14. As an alternative arrangement, beveled portion 24 has a lip 62 extending from and along beveled upper surface 24. This lip 62 would serve to engage an indentation formed along the inner surface of liquid container 14. This type of arrangement would permit a snap-type fit to occur between base section 16 and liquid container 14.

An insulating layer 64 is fastened within the interior of base section 16. This insulating layer is fixed to the interior of base section 16 adjacent to the shoulder portion 28. Microchip 42 is fixedly fastened to this insulating layer 64. Mercury switches 48 and 50 are shown in their desired position. In particular, the mercury switches 48 and 50 are tilted such that the off-position (illustrated in FIG. 4) is located closer to the bottom 68 of base section 16 than is the on-position of the mercury switches. This type of configuration means that the baby bottle 10 will be quiet when it is in an upright position. Baby bottle 10 will have music played when it is disturbed from this upright position.

FIG. 4 also shows that an insulating fill material 70, such as plastic, is fastened within the base section. This insulative fill material encapsulates the microchip 42, the speaker 44, the battery, and the switches 48 and 50. This insulative fill material is important since it serves to keep the infant using the baby bottle 10 from disturbing the electronics 40, from receiving an electrical shock, and from other dangers. It also gives the base section 16 a firmer bottom 68. This insulative fill material 70 can also be used to maintain and permanently affix the positions of the switches 48 and 50, and the speaker 44.

Figure 3:
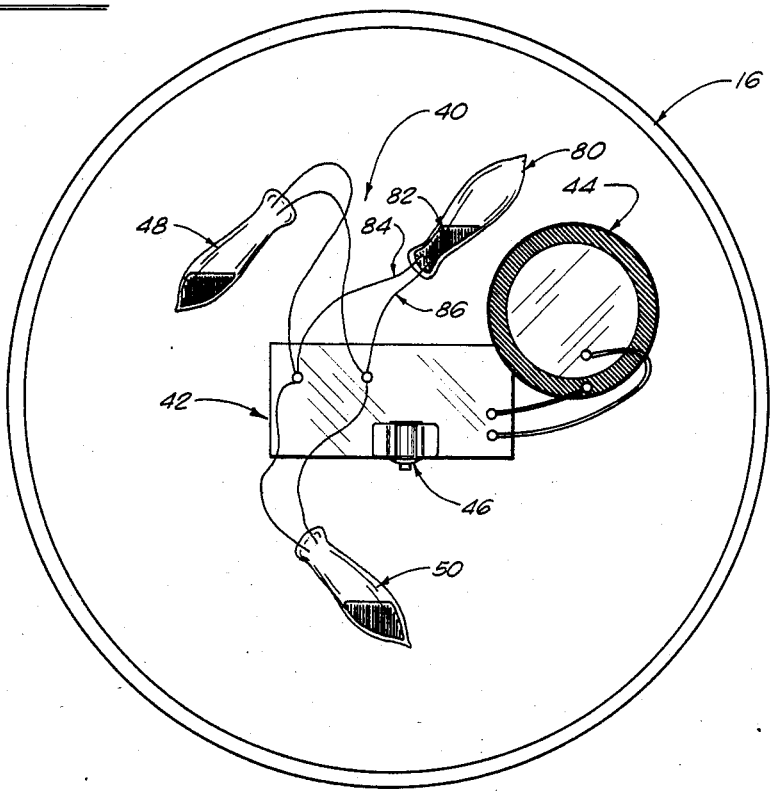
FIG. 3 is a cross-sectional view about the bottom of the baby bottle showing an alternative configuration.

FIG. 3 shows an alternative embodiment of the electronics 40 within the base section 16 of the present invention. In particular, FIG. 3 shows the addition of a third mercury switch 80 that is electrically connected to microchip 42. Third mercury switch 80 is angularly offset by 90 degrees from both the first mercury switch 48 and the second mercury switch 50. Third mercury switch 80 has a configuration similar to that of mercury switches 48 and 50. As with the first and second mercury switches, third mercury switch has an off-position that is closer to the bottom of base section than is the on-position. The addition of third mercury switch 80 allows the microchip to be more responsive to movements of the baby bottle. In FIG. 3, mercury switch 80 is shown with glob of mercury 82 in electrical contact with wires 84 and 86. As before, the first, second, and third mercury switches are connected to the microchip such that when any of the mercury switches are in the on-position, the microchip is activated to release the encoded musical information. All three mercury switches must be in the off position for the music to stop.

Figure 5:
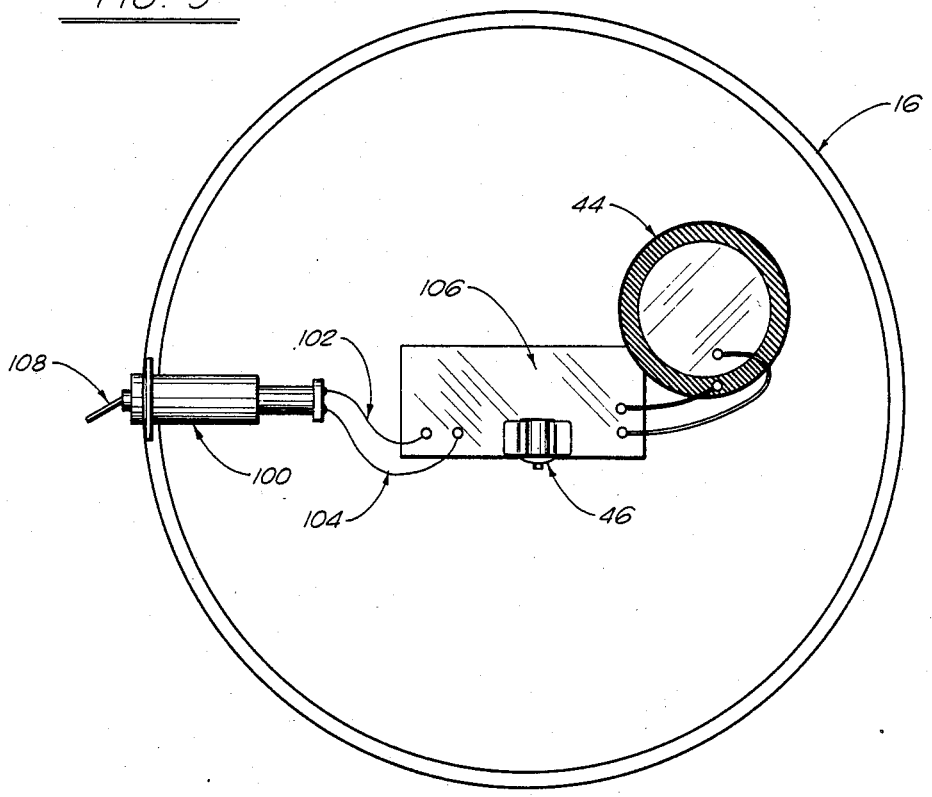
FIG. 5 is a cross-sectional end view showing an alternative configuration of the base section of the present invention.

FIG. 5 shows an alternative embodiment of the present invention. In particular, FIG. 5 shows a toggle switch 100 electrically connected by lines 102 and 104 to microchip 106. Toggle switch 100 is fastened to the exterior of base section 16. The toggle 108 of toggle switch 100 extends outwardly from the outer diameter of base section 16. Toggle 108 is actuable from the exterior of the baby bottle. The toggle 108 extends generally transverse to the longitudinal axis of the bottle 10. Toggle switch 108 allows the user to selectively choose whether to turn the music on or off. In the embodiment of FIG. 5, the movement of the baby bottle will not cause the activation of music. The embodiment of FIG. 5 requires that the toggle switch be turned from an on-position to an off-position before music is released.

Figure 6:
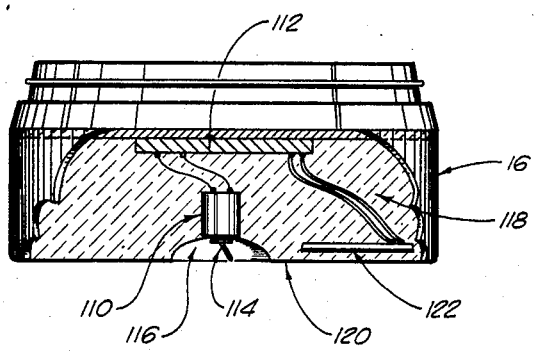
FIG. 6 is a cross-sectional view across the base section of the present invention showing an alternative embodiment of the present invention.

FIG. 6 shows an alternative manner of attaching the toggle switch shown in FIG. 5. In particular, toggle switch 110 is electrically connected to microchip 112. Toggle 114 extends outwardly from switch 110. An indentation 116 is formed in the insulative fill material 118 within base section 16. Indentation 116 is of a hemispherical configuration. In this arrangement, the end of toggle 114 is generally level with the bottom 120 of base section 16. The movement of the toggle switch 110 from the on-position to the off-position will selectively activate the microchip 112 and the resultant music from speaker 122. The configuration shown in FIG. 6 provides a certain amount of safety to the baby/user of the musical baby bottle of the present invention. Since the toggle switch 114 does not extend beyond the surface of the bottle, it is impossible for the baby to gouge himself or herself while playing with the baby bottle.

Figure 7:
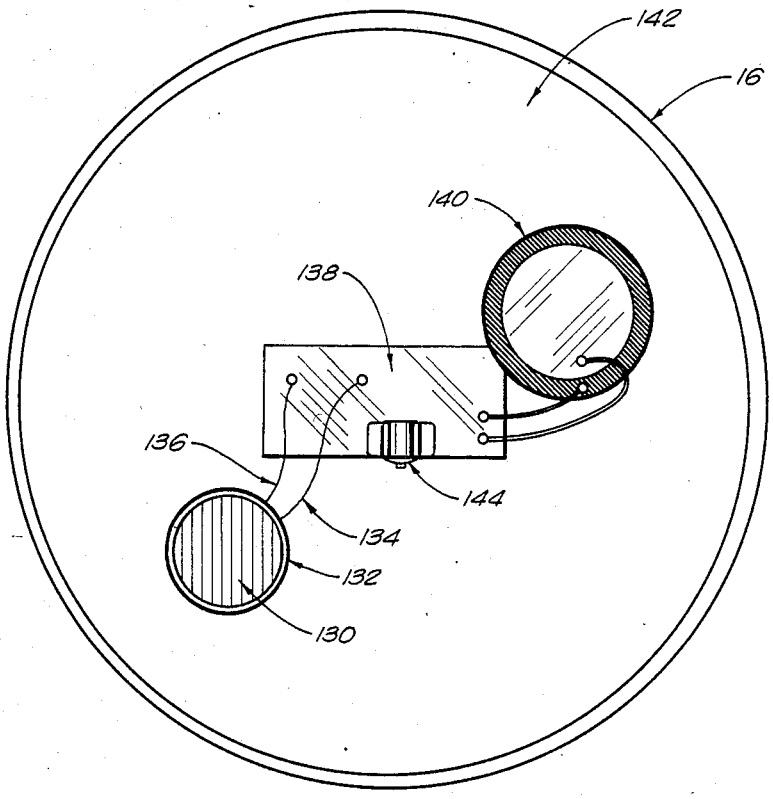
FIG. 7 is a cross-sectional view across the bottom of the present invention which shows an alternative embodiment of the present invention.

FIG. 7 shows another embodiment of the present invention. FIG. 7 shows base section 16 as having a type of push-button configuration. Button 130 is resiliently mounted within receiving section 132. Button 130 is electrically connected by lines 134 and 136 to microchip 138. Button 130 extends a small distance beyond the base section. Button 130 is in its off-position when the baby bottle is upright and resting on a surface. The button is in an on-position when the baby bottle 10 is lifted from such a surface. Also, button 113 can be used to selectively activate or deactivate the music produced from speaker 140.

An insulative fill material 142 will encapsulate the microchip 138, the battery 144, the receiving section 132 of button 130, and speaker 140. Only the exterior portion of button 130 will remain exposed. The exterior portion of button 130 has a flat end section so as to facilitate the placement of the bottom of base section 16 on a flat surface.

The musical baby bottle of the present invention, in its various embodiments, provides the baby/user of the baby bottle with musical entertainment. This music can be produced by selectively activating the music-producing microchip or by the movement of the bottle itself. This device will provide amusement for the baby and, potentially, help in the feeding habits of the baby. The device of the present invention is relatively inexpensive to manufacture and is easily adaptable to a wide variety of different baby bottles on the market.

The foregoing disclosure and description is illustrative and explanatory thereof. Various changes in the size, shape, and materials, as well as in the details of the illustrated construction, may be made within the scope of appended claim without departing from the spirit of the invention. This invention should only be limited by the appended claims and their legal equivalents.

I claim:

1. A musical baby bottle comprising:

a nipple;

a liquid container connected to said nipple such that a liquid passes from said liquid container to said nipple, said liquid container having an opening at the end opposite said nipple;

a base section fastened to said opening of said liquid container, said base section having a generally round exterior configuration, said base section having a beveled upper surface which engages the inner surface of said liquid container, said beveled upper surface slidingly engaging said inner surface of said liquid container, said base section having a lip extending from said beveled upper surface, said lip engaging said inner surface of said liquid container, said base section having a flat surface across the top of said beveled upper surface, said flat surface sealing the interior of said base section from the interior of said liquid container, said base section having a shoulder area formed at the bottom of said beveled upper surface, said shoulder abutting the end of said liquid container;

a microchip having musical information encoded therein, said microchip fastened to the interior portion of said base section, said microchip fastened to the side of said flat surface opposite the interior of said liquid container;

an insulating layer fastened to the side of said flat surface opposite the interior of said liquid container, said microchip fastened to the opposite side of said insulating layer from said flat surface;

a speaker electrically connected to said microchip, said speaker fastened within the interior of said base section, said speaker being a generally flat speaker, said speaker positioned adjacent an outer surface of said base section;

a battery electrically connected to said microchip, said battery fastened within the interior of said base section; and switch means electrically connected to said microchip, said switch means for selectively activating said microchip, said switch means responsive to external stimulus acting on said baby bottle, said switch means comprising:

a first mercury switch fixedly positioned within said base section, said first mercury switch tilted such that the off-position of said switch is tilted toward the bottom of said base section, the on-position of said first mercury switch being farther from the bottom of said base section than said off-position;

a second mercury switch fixedly positioned within said base section, said second mercury switch being angularly offset by 90 degrees from said first mercury switch; and a third mercury switch fixedly positioned within said base section, said third mercury switch angularly offset by 90 degrees from both said first mercury switch and said second mercury switch, said second and third mercury switches having an off-position closer to the bottom of said base section than the on-position, said first, second and third mercury switches responsive to an angular movement of said baby bottle, said first, second and third mercury switches connected to said microchip such that when any of said mercury switches are in the on-position, the microchip is activated to release the encoded musical information.

2. The bottle of claim 1, further comprising:

an insulative plug material filling the interior of said base section, said plug material fixed in position over said microchip and said battery.

3. The bottle of claim 1, further comprising insulative fill material fastened within said base section, said insulative fill material encapsulating said microchip, said speaker, said battery, and said switch means such that each is inaccessible from the exterior of said base section.

* * * * *